US005760701A

United States Patent [19]

Mitsumoto

[11] Patent Number: 5,760,701

[45] Date of Patent: Jun. 2, 1998

[54] KEYLESS ENTRY SYSTEM

[75] Inventor: Yoshihiro Mitsumoto, Atsugi, Japan

[73] Assignee: Nissan Motor Co., Ltd., Yokohama, Japan

[21] Appl. No.: 617,952

[22] Filed: Mar. 13, 1996

[30] Foreign Application Priority Data

Mar. 13, 1995 [JP] Japan ..... 7-052968

[51] Int. Cl.[6] ..... B06R 25/00; H04K 1/00; G08C 19/00

[52] U.S. Cl. ..... 340/825.31; 340/825.34; 340/825.69; 340/825.72; 70/278; 307/9.1; 307/10.2; 307/10.4; 307/10.5; 180/287; 380/4; 380/23

[58] Field of Search ..... 340/825.31, 825.34, 340/825.69, 825.72; 307/9.1, 10.2, 10.5, 10.4; 180/287; 70/278, 237; 380/4, 23

[56] References Cited

U.S. PATENT DOCUMENTS

| | | | |
|---|---|---|---|
| 4,492,959 | 1/1985 | Mochida et al. | 340/825.56 |
| 4,670,746 | 6/1987 | Taniguchi et al. | 340/825.31 |
| 4,672,375 | 6/1987 | Mochida et al. | 340/825.31 |
| 4,688,036 | 8/1987 | Hirano et al. | 340/825.69 |
| 5,369,706 | 11/1994 | Latka | 380/23 |
| 5,412,379 | 5/1995 | Waraksa et al. | 340/825.72 |
| 5,420,925 | 5/1995 | Michaels | 380/23 |
| 5,532,522 | 7/1996 | Dietz et al. | 307/10.5 |

OTHER PUBLICATIONS

Nissan Motor Co., Ltd., 1994 J30 Service Manual, Overseas Service Department, Tokyo, Japan (copyright notice date 1993).

*Primary Examiner*—Brian Zimmerman
*Assistant Examiner*—Yonel Beaulieu
*Attorney, Agent, or Firm*—Foley & Lardner

[57] ABSTRACT

A keyless entry system for use with a mobile transmitter for transmitting an ID code specified therefor along with a command for vehicle door lock/unlock remote control to a control unit. The control unit is operable in an ID code registration mode for registering an ID code transmitted from the mobile transmitter. The transmitted ID code is compared with the registered ID code to permit the remote control specified by the transmitted command when the transmitted ID code is identical with the registered ID code. Upon completion of a first predetermined procedure including a plurality of sequential events of at least one first movable vehicle member provided on the vehicle, a second movable vehicle member is changed from a first position to a second position. The control unit is placed in the ID code registration mode upon the sequential occurrence of three events of (1) the second movable member is changed to the second position, (2) the ignition key is placed in a predetermined position within the key receptacle and (3) the second movable member is returned to the first position in this order.

26 Claims, 5 Drawing Sheets

KEYLESS ENTRY SYSTEM

BACKGROUND OF THE INVENTION

This invention relates to a keyless entry system for a vehicle door lock or an unlock remote control.

Keyless entry systems have been used for vehicle door lock/unlock control at a position remote from the vehicle. Such a conventional keyless entry system is used with a mobile transmitter of the type having door lock/unlock buttons for transmitting a command causing the vehicle doors to be locked or unlocked when depressed at a position remote from the vehicle. The keyless entry system has a keyless entry control unit which permits the remote control only when the ID code transmitted along with the command from the mobile transmitter is identical with the ID code registered therein. Some keyless entry control units are configured to register a plurality of ID codes in response to commands transmitted from different mobile transmitters. It is the current practice to avoid the high cost of the switches specified for the registration of the respective ID codes by operating the keyless entry control unit in its ID code registration mode as long as the operator operates the ignition key or the like provided for the vehicle in a predetermined procedure. If the procedure required for the keyless entry control unit to operate in the ID code registration mode is simplified, however, the possibility increases that the keyless entry control unit would operate in the ID code registration mode against the operator's intention. Furthermore, the antitheft effect would be reduced. If the procedure is complicated to avoid the above difficulties, it would take much time to register the ID codes.

SUMMARY OF THE INVENTION

It is a main object of the invention to provide an improved keyless entry system which permits easy and prompt ID code registration without any complicated procedure.

Another object of the invention is to provide an improved keyless entry system which can provide a good antitheft effect.

There is provided, in accordance with the invention, a keyless entry system for use with an automotive vehicle having an internal combustion engine, first and second movable members and a key receptacle. The keyless entry system comprises an ignition key for operation within the key receptacle to start the engine, a mobile transmitter for transmitting an ID code specified therefor along with a command for vehicle door lock/unlock remote control, and a control unit operable in an ID code registration mode for registering an ID code transmitted from the mobile transmitter. The control unit includes means for comparing the transmitted ID code with the registered ID code to permit the remote control specified by the transmitted command when the transmitted ID code is identical with the registered ID code, means responsive to completion of a first predetermined procedure including a plurality of sequential events of at least the first movable member for changing the second movable member from a first position to a second position, and means for placing the control unit in the ID code registration mode upon the occurrence of three events comprising (1) the second movable member is changed to the second position, (2) the ignition key is placed in a predetermined position within the key receptacle and (3) the second movable member is returned to the first position in this order.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
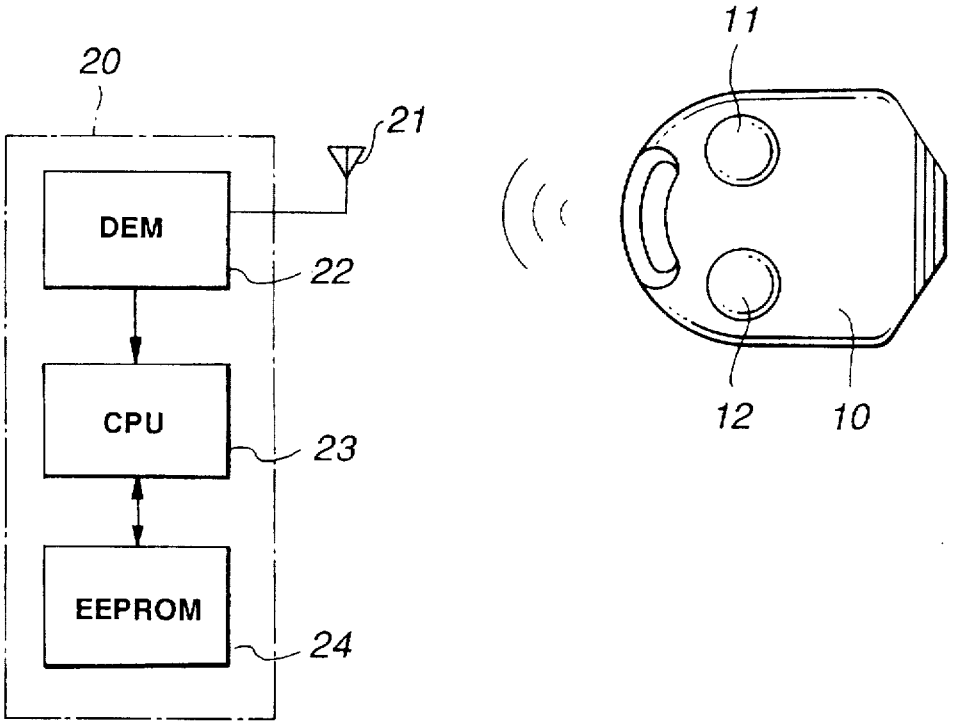
FIG. 1 is a schematic diagram of a keyless entry system embodying the invention.

With reference to the drawings and in particular to FIG. 1, there is shown one embodiment of a keyless entry system of the invention. This invention is intended for use with an automotive vehicle having a key receptacle in which an ignition key is placed to start the engine. The key is placed in one of the "OFF", "ON", "START" and "ACCESSORY" positions within the key receptacle. The keyless entry system employs a mobile transmitter 10 having a door lock button 11 and a door unlock button 12. The door lock button 11 is depressed to produce a signal which includes a command causing the vehicle doors to be locked along with an ID code specified for the mobile transmitter 10. The door unlock button 12 is depressed to produce a signal which includes a command causing the vehicle doors to be unlocked along with the ID code specified for the mobile transmitter 10.

The keyless entry system includes a keyless entry control unit 20 having an antenna 21, a demodulator (DEM) 22, a micro-processor (CPU) 23 and a memory (EEPROM) 24. The demodulator 22 receives a signal transmitted from the mobile transmitter 10 to the antenna 21. The demodulator 22 demodulates the received signal into ID code information and function code information. The demodulated ID code information is fed from the demodulator 22 to the micro-processor 23 which compares the received ID code with an ID code stored in the memory 24. The demodulated function code information is fed from the demodulator 22 to the micro-processor 23 which produces a corresponding command to lock or unlock the vehicle doors when the received ID code is identical with the stored or registered ID code.

Figure 2:
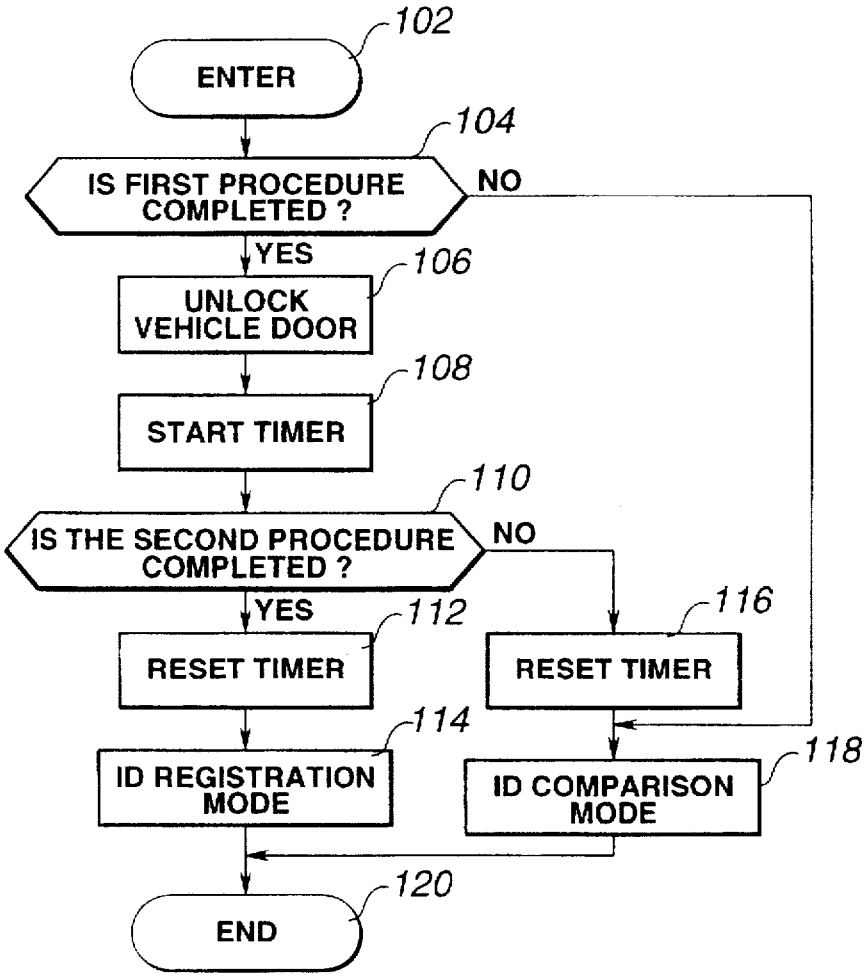
FIG. 2 is a flow diagram showing the programming of the digital computer as it is used for selection of the ID code registration mode of operation of the keyless entry unit.

FIG. 2 is a flow diagram illustrating the programming of the digital computer as it is used in the micro-processor 23 to select one of the ID code registration and ID code comparison modes of operation of the keyless entry unit 20. The computer program is entered at the point 102. At the point 104 in the program, a determination is made as to whether or not a first procedure has been completed. The first procedure includes the following events made to occur in the following order: (1) the vehicle doors are closed, (2) the vehicle doors are locked and (3) the key is taken out and put in the key receptacle several times within a period of time, for example, 10 seconds. If the answer to this question is "YES", then the program proceeds to the point 106 where a command is produced to instruct the door lock actuator (not shown) to unlock a predetermined one of the vehicle doors, for example, the vehicle door on the side of the driver's seat. This step is intended to confirm the operator's demand for the ID code registration. At the point 108 in the program, a command is produced to start a timer.

At the point 110 in the program, a determination is made as to whether or not a second procedure has been completed.

If the answer to this question is "YES", then the program proceeds to the point 112 where the timer is reset. Thereafter, the program proceeds to the point 114 where the ID code registration mode is selected. In the ID code registration mode, the ID code transmitted from the mobile transmitter 10 is, registered in the memory 24. Upon completion of this ID code registration, the, program proceeds to the end point 120. When an ID code has been registered in the memory 24, the new ID code may be used to update the old ID code registered in the memory 24.

If the answer to the question inputted at the point 110 is "NO", then the program proceeds to the point 116 where the timer is reset. Thereafter, the program proceeds to the point 118 where the ID code comparison mode is selected to produce a command causing the door lock actuator (not shown) to lock or unlock the vehicle doors according to the function code information transmitted from the mobile transmitter 10. Following this, the program proceeds to the end point 120. If the answer to the question inputted at the point 104 is "NO", then the program proceeds to the point 118.

Figure 3:
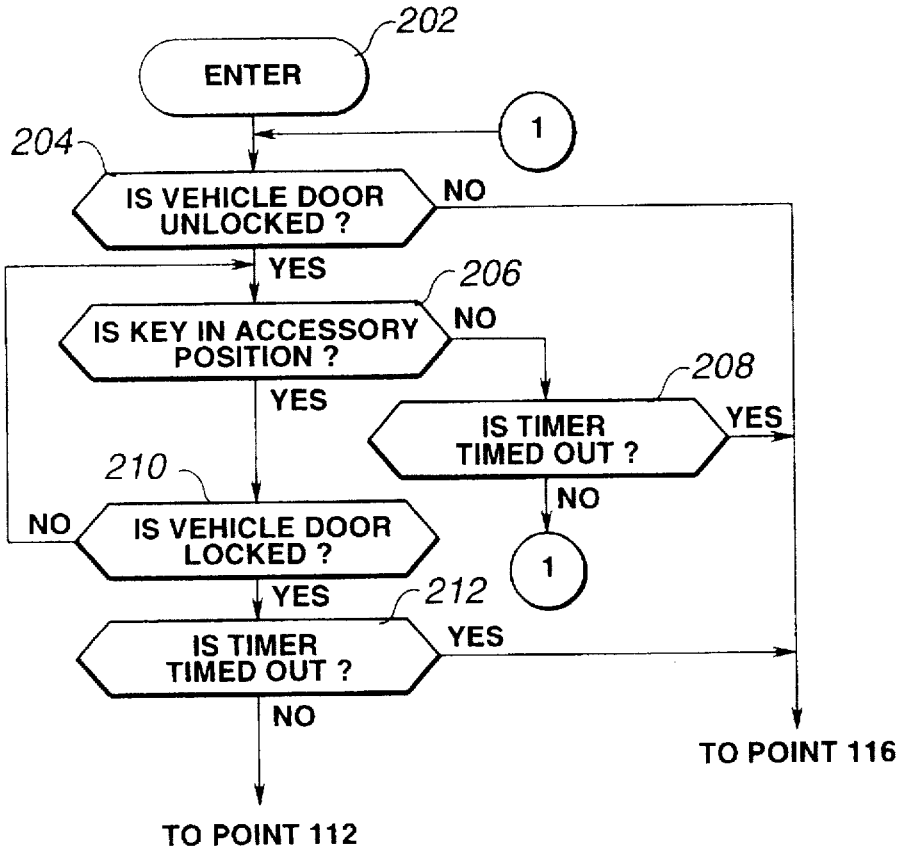
FIG. 3 is a detailed flow diagram for the digital computer as programmed to execute the second procedure.

FIG. 3 is a detailed flow diagram showing the programming of the digital computer as it is used to execute the second procedure. At the point 202 in FIG. 3, which corresponds to the point 110 of the program of FIG. 2, the computer program is entered. At the point 204 in the program, a determination is made whether or not a predetermined vehicle door, for example, the vehicle door on the side of the driver's seat is unlocked. This step is to confirm that the first procedure have been completed in a correct matter. If the answer to this question is "YES", then it means correct completion of the first procedure and the program proceeds to the point 206. Otherwise, the program proceeds to the point 116 of the program of FIG. 2. That is, the ID code registration, mode is inhibited if the predetermined vehicle door is not unlocked.

At the point 206 in the program, a determination is made as to whether or not the key is placed in the "ACCESSORY" position. If the answer to this question is "YES then the program proceeds to the point 210. Otherwise, the program proceeds to another determination point 208. This determination is as to whether or not the timer is timed out. If the answer to this question is "YES", then it means that the key is not placed in the "ACCESSORY" position within a predetermined period of time after the predetermined vehicle door is unlocked and the program proceeds to the point 116 of the program of FIG. 2. Otherwise, the program is returned to the point 204.

At the point 210 in the program, a determination is made as to whether or not the predetermined vehicle door has been locked. If the answer to this question is "YES", then the program proceeds to the point 212. Otherwise, the program returned to the point 206. At the point 212, a determination is made as to whether or not the timer is timed out. If the answer to this question is "YES", then it means that the driver does not lock the predetermined vehicle door within the predetermined period of time after the predetermined vehicle door is unlocked at the point 106 of the program of FIG. 2 and the program proceeds to the point 116 of the program of FIG. 2. That is, the keyless entry control unit 20 is prevented from operating in the ID code registration mode in this case. Otherwise, the program proceeds to the point 112 of the program of FIG. 2. That is, the keyless entry control unit 20 is permitted to operate in the ID code registration mode in this case.

As described above, the ID code registration mode of operation of the keyless entry control unit 20 is inhibited unless both of the first and second predetermined procedures have, been completed correctly. This is effective to avoid the danger of starting the ID code registration mode of operation of the keyless entry control unit 20 against the operator's intention. This is also effective to increase the antitheft effect.

If an erroneous operation occurs during the first or second procedure, the keyless entry control unit 20 is placed into the ID code comparison mode. This permits the operator to lock or unlock the vehicle doors without any operator's mode switching operation when the operator has no intention to register the ID code.

Figure 4:
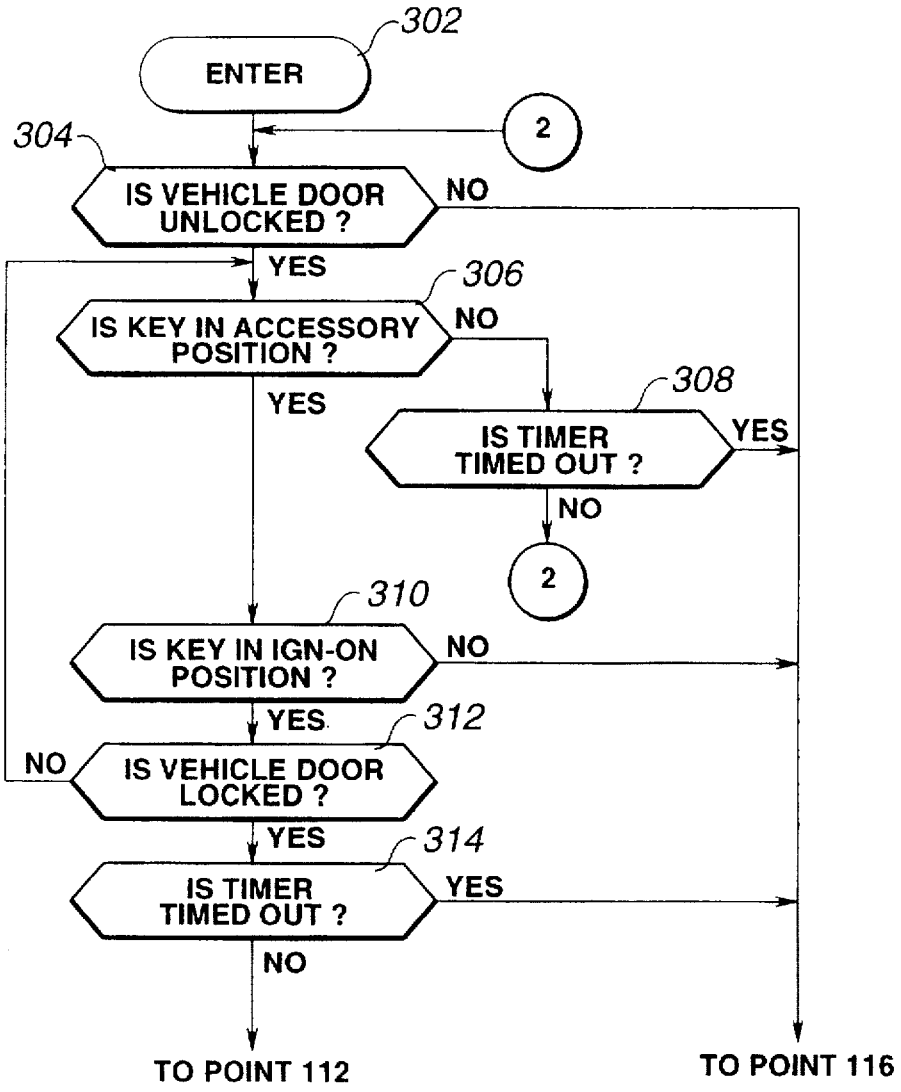
FIG. 4 is a detailed flow diagram showing the programming of the digital computer as it is used to execute a modified form of the second procedure.

FIG. 4 is a detailed flow diagram showing the programming of the digital computer as it is used to execute a modified form of the second procedure. At the point 302 in FIG. 4, which corresponds to the point 110 of the program of FIG. 2, the computer program is entered. At the point 304 in the program, a determination is made whether or not a predetermined vehicle door for example, the vehicle door on the side of the driver's seat is unlocked. This step is to confirm that the first procedure have been completed in a correct matter. If the answer to this question is "YES", then it means correct completion of the first procedure and the program proceeds to the point 306. Otherwise, the program proceeds to the point 116 of the program of FIG. 2. That is, the ID code registration mode is inhibited if the predetermined vehicle door is not unlocked.

At the point 306 in the program, a determination is made as to whether or not the key is placed in the "ACCESSORY" position. If the answer to this question is "YES", then the program proceeds to the point 310. Otherwise, the program proceeds to another determination point 308. This determination is as to whether or not the timer is timed out. If the answer to this question is "YES", then it means that the key is not placed in the "ACCESSORY" position within a predetermined period of time after the predetermined vehicle door is unlocked and the program proceeds to the point 116 of the program of FIG. 2. Otherwise, the program is returned to the point 304.

At the point 310 in the program, a determination is made as to whether or not the key is placed in its "ignition on" ("IGN-ON") position. If the answer to this question is "YES", then the program proceeds to the point 312. Otherwise, the program proceeds to the point 116 of the program of FIG. 2. That is, the ID code registration mode of operation of the keyless entry control unit 20 is inhibited unless the key is placed into the "IGN-ON" position after the key is placed in, the ACCESSORY" position. At the point 312 in the program, a determination is made as to whether or not the predetermined vehicle door has been locked. If the answer to this question is "YES", then the program proceeds to the point 314. Otherwise, the program returned to the point 306. At the point 314, a determination is made as to whether or not the timer is timed out. If the answer to this question is "YES", then it means that the driver does not lock the predetermined vehicle door within the predetermined period of time after the predetermined vehicle door is unlocked at the point 106 of the program of FIG. 2 and the program proceeds to the point 116 of the program of FIG. 2. That is, the keyless entry control unit 20 is prevented from operating in the ID code registration mode in this case. Otherwise, the program proceeds to the point 112 of the program of FIG. 2. That is, the keyless entry control unit 20 is permitted to operate in the ID code registration mode in this case.

As described above, the ID code registration mode of operation of the keyless entry control unit 20 is inhibited unless the key is placed into the "IGN-ON" position after the key is in the "ACCESSORY" position.

This is effective to further decrease the danger of starting the ID code registration mode of operation of the keyless entry control unit 20 against the operator's intention. This is also effective to further increase the antitheft effect.

It is to be understood that a similar effect may be obtained when the determination step at the point 310 is replaced with a determination as to whether or not the key is in the "START" position.

Figure 5:
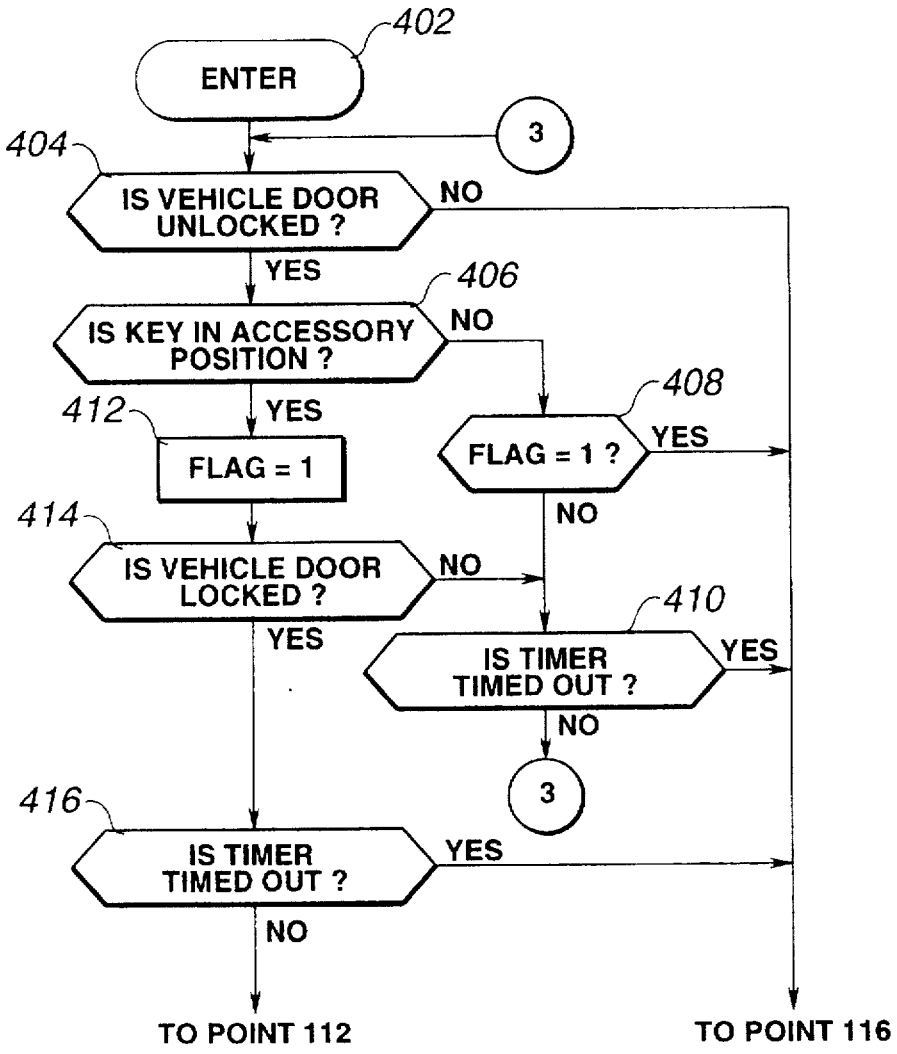
FIG. 5 is a detailed flow diagram showing the programming of the digital computer as it is used to execute another modified form of the second procedure.

FIG. 5 is a detailed flow diagram showing the programming of the digital computer as it is used to execute another modified form of the second procedure. At the point 402 in FIG. 5, which corresponds to the point 110 of the program of FIG. 2, the computer program is entered. At the point 404 in the program, a determination is made whether or not a predetermined vehicle door, for example, the vehicle door on the side of the driver's seat is unlocked. This step is to confirm that the first procedure have been completed in a correct matter. If the answer to this question is "YES", then it means correct completion of the first procedure and the program proceeds to the point 406. Otherwise, the program proceeds to the point 116 of the program of FIG. 2. That is, the ID code registration mode is inhibited if the predetermined vehicle door is not unlocked.

At the point 406 in the program, a determination is made as to whether or not the key is placed in the "ACCESSORY" position. If the answer to this question is "YES", then the program proceeds to the point 412 where a flag is set. This flag is set to indicate that the key has been placed in the "ACCESSORY" position. Otherwise, the program proceeds to another determination point 408. This determination is as to whether or not the flag is set. If the answer to this question is "YES", then the program proceeds to the point 116 of the program of FIG. 2. Otherwise, the program proceeds to another determination step at the point 410. This determination is as to whether or not the timer is timed out. If the answer to this question is "YES", then it means that the key is not placed in the "ACCESSORY" position within a predetermined period of time after the predetermined vehicle door is unlocked and the program proceeds to the point 116 of the program of FIG. 2. Otherwise, the program is returned to the point 404.

At the point 414 in the program, a determination is made as to whether or not the predetermined vehicle door has been locked. If the answer to this question is "YES", then the program proceeds to the point 416. Otherwise, the program returned to the point 410. At the point 416, a determination is made as to whether or not the timer is timed out. If the answer to this question is "YES", then it means that the driver does not lock the predetermined vehicle door within the predetermined period of time after the predetermined vehicle door is unlocked at the point 106 of the program of FIG. 2 and the program proceeds to the point 116 of the program of FIG. 2. That is, the keyless entry control unit 20 is prevented from operating in the ID code registration mode in this case. Otherwise, the program proceeds to the point 112 of the program of FIG. 2. That is, the keyless entry control unit 20 is permitted to operate in the ID code registration mode in this case.

As described above, the ID code registration mode of operation of the keyless entry control unit 20 is inhibited when the key position is changed before the predetermined door is locked after the key is placed in the "ACCESSORY" position. This is effective to further decrease the danger of starting the ID code registration mode of operation of the keyless entry control unit 20 against the operator's intention. This is also effective to further increase the antitheft effect.

The invention has been described in connection with the keyless, entry control unit operable in its ID code registration mode only when the operator completes the first and second procedures in a correct manner. The first and second procedures are not limited in any way to the events described above. While the predetermined vehicle door is unlocked, at the point 106 of the program of FIG. 2, after the completion of the first procedure, it is to be understood that the program may be arranged to actuate a buzzer rather than the vehicle door unlocking operation. In this case, the ID code registration mode of operation of the keyless entry control unit is permitted when the operator stops the buzzer within a predetermined period of time after the buzzer goes on.

While the invention has been described in connection with a keyless entry system arranged for vehicle door locked/unlocked condition remote control with the mobile transmitter 10, it is to be understood that the system may be arranged to change-over the electric power to the electric devices such as room lamps, air conditioners and the like. While the invention has been described in connection with a keyless entry system utilizing radio-electric links formed between the mobile transmitter 10 and the keyless entry control unit 20, it is to be understood that the system may be arranged to utilize infrared-ray links formed between the mobile transmitter 10 and the keyless entry control unit 20.

What is claimed is:

1. A keyless entry system for use with an automotive vehicle having an internal combustion engine, first and second movable members and a key receptacle, comprising:

an ignition key for operation within the key receptacle to start the engine;

a mobile transmitter for transmitting an ID code specified therefor along with a command for vehicle door lock/unlock remote control; and a control unit provided on the vehicle, the control unit including a memory for storing an ID code therein, the control unit including means operable in an ID code registration mode for storing an ID code transmitted from the mobile transmitter in the memory, means for comparing the transmitted ID code with the stored ID code to permit the remote control specified by the transmitted command when the transmitted ID code is identical with the stored ID code, means responsive to completion of a first predetermined procedure including a plurality of sequential events of at least the first movable member for changing the second movable member from a first position to a second position, and means for placing the control unit in the ID code registration mode upon the occurrence of three events including: (1) the second movable member is changed to the second position (2) subsequent to event (1), the ignition key is placed in a, predetermined position within the key receptacle; and (3) subsequent to event (2), the second movable member is returned to the first position.

2. The keyless entry system as claimed in claim 1, wherein the control unit includes means for inhibiting the ID code registration mode when the ignition key is placed in the predetermined position within a predetermined period of time.

3. The keyless entry system as claimed in claim 2, wherein the control unit includes means for inhibiting the ID code registration mode when the ignition key is placed in a position other than the predetermined position after the ignition key is placed in the predetermined position and before the second movable member is returned to the first position.

4. The keyless entry system as claimed in claim 2, wherein the second movable member is a door lock knob, the first position is a door lock position, and the second position is a door unlock position.

5. The keyless entry system as claimed in claim 2, wherein the first procedure includes the following events made to occur in the following order: (1) the vehicle doors are closed, (2) the vehicle doors are locked, and (3) the ignition key is taken out and put in the key receptacle several times.

6. The keyless entry system as, claimed in claim 1, wherein the control unit includes means for inhibiting the ID code registration mode when the ignition key is placed in a position except for the predetermined position after the ignition key is placed in the predetermined position and before the second movable member is returned to the first position.

7. The keyless entry system as claimed in claim 6, wherein the second movable member is a door lock knob, the first position is a door lock position, and the second position is a door unlock position.

8. The keyless entry system as claimed in claim 6, wherein the first procedure includes the following events made to occur in the following order: (1) the vehicle doors are closed, (2) the vehicle doors are locked, and (3) the ignition key is taken out and put in the key receptacle several times.

9. The keyless entry system as claimed in claim 1, wherein the control unit includes means for placing the control unit into the ID code registration mode upon occurrence including three events of (1) the ignition key is placed in a third position within a predetermined period of time after the second movable member is changed to the second position, (2) the ignition key is placed in a fourth position, and (3) the second movable member is returned to the first position.

10. The keyless entry system as claimed in claim 9, wherein the second movable member is a door lock knob, the first position is a door lock position, and the second position is a door unlock position.

11. The keyless entry system as claimed in claim 9, wherein the first procedure includes the following events made to occur in the following order: (1) the vehicle doors are closed, (2) the vehicle doors are locked, and (3) the ignition key is taken out and put in the key receptacle several times.

12. The keyless entry system as claimed in claim 1, wherein the second movable member is a door lock knob, the first position is a door lock position, and the second position is a door unlock position.

13. The keyless entry system as claimed in claim 12, wherein the first procedure includes the following events made to occur in the following order: (1) the vehicle doors are closed, (2) the vehicle doors are locked, and (3) the ignition key is taken out and put in the key receptacle several times.

14. The keyless entry system as claimed in claim 1, wherein the first procedure includes the following events made to occur in the following order: (1) the vehicle doors are closed, (2) the vehicle doors are locked, and (3) the ignition key is taken out and put in the key receptacle several times.

15. A keyless entry system used in a land vehicle to lock and unlock the door on receiving an ID code, comprising:

a transmitter independent from the vehicle to transmit the ID code;

a receiver disposed in the vehicle for receiving the transmitted ID code;

a memory disposed in the vehicle;

a movable member disposed in the vehicle which is movable between a first position and a second position; and a memory controller connected to the receiver, the memory and the movable member.

the memory controller outputting an instruction signal to move the movable member from the second position to the first position after the movable member is operated to move from the first position to the second position by an operator, and the memory controller storing the received ID code in the memory when the movable member is returned from the first position to the second position by the operator after the instruction signal is outputted.

16. The keyless entry system as defined in claim 15, wherein the movable member is a door lock knob located inside of the vehicular door, and wherein the door lock knob is in the first position when the door is locked and in the second position when the door is unlocked.

17. The keyless entry system as defined in claim 15, wherein the memory controller stores the received ID code in the memory when the movable member is returned from the first position to the second position by the operator within a predetermined period of time after the instruction signal is outputted.

18. The keyless entry system as defined in claim 15, further comprising:

an ignition key; and a key receptacle operative with the ignition key inserted therein to start an engine of the vehicle;

wherein the memory controller stores the received ID code in the memory when the movable member is returned from the first position to the second position and the ignition key is positioned in a third position by the operator after the instruction signal is outputted.

19. The keyless entry system as defined in claim 18, wherein the third position is an accessory position of the key receptacle.

20. The keyless entry system as defined in claim 18, wherein the memory controller stores the received ID code in the memory when the movable member is returned from the first position to the second position and the ignition key is positioned to a fourth position from the third position by the operator after the instruction signal is outputted.

21. The keyless entry system as defined in claim 20, wherein the fourth position is an ON position of the key receptacle.

22. The keyless entry system as defined in claim 18, wherein the memory controller stores the received ID code in the memory when the movable member is returned from the first position to the second position and the ignition key is positioned in a third position by the operator within a predetermined period of time after the movable member is operated to move from the first position to the second position by an operator for the first time.

23. The keyless entry system as defined in claim 18, wherein the memory controller prohibits to store the ID code in the memory when the ignition key is operated from the third position to a position other than the third position between the instruction signal is outputted and the movable member is returned from the first position to the second position.

24. The keyless entry system as defined in claim 18, wherein the movable member is a door lock knob located inside of the vehicular door, and wherein the door lock knob is in the first position when the door is locked and in the second position when the door is unlocked.

25. The keyless entry system as defined in claim 24, wherein the memory controller outputs an instruction signal to move the door lock knob from the locking position to the unlocking position after the door of the vehicle is closed, the door lock knob is moved from the unlocked position to the locking position, and the ignition key is inserted to and put out of the key receptacle several times by an operator, the memory controller stores the received ID code in the memory when the door lock knob is returned from the unlocking position to the locking position by the operator after the instruction signal is outputted.

26. A remote control system used in a land vehicle for controlling an apparatus in the vehicle on receiving an ID code, comprising:

a transmitter independent from the vehicle to transmit the ID code;

a receiver disposed in the vehicle for receiving the transmitted ID code;

a memory disposed in the vehicle;

a movable member disposed in the vehicle movable between a first position and a second position; and a memory controller connected to the receiver, the memory and the movable member, the memory controller outputting an instruction signal to move the movable member from the second position to the first position after the movable member is operated to move from the first position to the second position by an operator, and the memory controller storing the received ID code in the memory when the movable member is returned from the first position to the second position by the operator after the instruction signal is outputted.

* * * * *